US012297542B2

(12) United States Patent
Ohishi et al.

(10) Patent No.: US 12,297,542 B2
(45) Date of Patent: May 13, 2025

(54) PLATED SUBSTRATE

(71) Applicants: SHIBAURA INSTITUTE OF TECHNOLOGY, Tokyo (JP); Murata Manufacturing Co., Ltd., Nagaokakyo (JP)

(72) Inventors: Tomoji Ohishi, Hitachi (JP); Yasushi Yoshida, Nagaokakyo (JP); Katsuro Hirayama, Nagaokakyo (JP)

(73) Assignees: SHIBAURA INSTITUTE OF TECHNOLOGY, Tokyo (JP); MURATA MANUFACTURING CO., LTD., Nagaokakyo (JP)

( * ) Notice: Subject to any disclaimer, the term of this patent is extended or adjusted under 35 U.S.C. 154(b) by 283 days.

(21) Appl. No.: 17/820,367

(22) Filed: Aug. 17, 2022

(65) Prior Publication Data

US 2022/0403524 A1 Dec. 22, 2022

Related U.S. Application Data

(63) Continuation of application No. PCT/JP2021/006135, filed on Feb. 18, 2021.

(30) Foreign Application Priority Data

Feb. 19, 2020 (JP) ..... 2020-026618

(51) Int. Cl.

| | |
|---|---|
| ***C23C 18/30*** | (2006.01) |
| ***C23C 18/16*** | (2006.01) |
| ***C23C 18/20*** | (2006.01) |
| ***C23C 18/38*** | (2006.01) |

(52) U.S. Cl.
CPC ..... *C23C 18/30* (2013.01); *C23C 18/1641* (2013.01); *C23C 18/1682* (2013.01); *C23C 18/204* (2013.01); *C23C 18/38* (2013.01)

(58) Field of Classification Search
None
See application file for complete search history.

(56) References Cited

U.S. PATENT DOCUMENTS

2006/0159854 A1 7/2006 Yanagimoto et al.

FOREIGN PATENT DOCUMENTS

| | | | | |
|---|---|---|---|---|
| CN | 109576684 | A | 4/2019 | |
| JP | H6076668 | B2 | 9/1994 | |
| JP | 2006188757 | A | 7/2006 | |
| JP | 2011225929 | A | 11/2011 | |
| JP | 2018123261 | A | 8/2018 | |
| WO | WO-2017191260 | A1 * | 11/2017 | ..... C23C 18/1844 |

OTHER PUBLICATIONS

International Search Report in PCT/JP2021/006135, mailed Apr. 27, 2021, 3 pages.

* cited by examiner

*Primary Examiner* — Ramsey Zacharia
(74) *Attorney, Agent, or Firm* — ArentFox Schiff LLP

(57) ABSTRACT

A modified resin base material that includes a resin material having a base at a surface thereof, and a plating catalytic metal on the surface of the resin material, wherein a combination of the plating catalytic metal and the base is at least one of the following Lewis acid-base combinations according to a HSAB principle: a hard acid and a hard base or an intermediate base, an intermediate acid and a hard base, an intermediate base or a soft base, or a soft acid and an intermediate base or a soft base.

4 Claims, 1 Drawing Sheet

PLATED SUBSTRATE

CROSS REFERENCE TO RELATED APPLICATIONS

The present application is a continuation of International application No. PCT/JP2021/006135, filed Feb. 18, 2021, which claims priority to Japanese Patent Application No. 2020-026618, filed Feb. 19, 2020, the entire contents of each of which are incorporated herein by reference.

FIELD OF THE INVENTION

The present disclosure relates to a plated substrate and a method for manufacturing the same.

BACKGROUND OF THE INVENTION

As a method for forming a metal layer on an insulating substrate, electroless plating is used. When a metal layer is formed by electroless plating on a surface of an insulating base material, Pd is usually provided as a plating catalytic metal for promoting deposition of metal to the surface of the base material (Patent Document 1).

Patent Document 1: JP-A-2011-225929

SUMMARY OF THE INVENTION

Although applying Pd as a plating catalytic metal to the surface of the base material makes it possible to perform electroless plating as described above, there may arise a problem that adhesion between the base material and the metal layer cannot be sufficiently obtained. In particular, the smoother the surface of the base material, the more remarkable this problem.

An object of the present disclosure is to provide a plated substrate comprising a resin base material and a plating layer formed by electroless plating on the resin base material, the plated substrate having high adhesion between the resin base material and the plating layer, and a method for manufacturing the plated substrate.

The present disclosure includes the following embodiments:

[1] A modified resin base material comprising: a resin material having a base at a surface thereof; and a plating catalytic metal on the surface of the resin material, wherein a combination of the plating catalytic metal and the base is at least one of the following Lewis acid-base combinations according to a HSAB principle: a hard acid and a hard base or an intermediate base, an intermediate acid and a hard base, an intermediate base or a soft base, or a soft acid and an intermediate base or a soft base.

[2] The modified resin base material according to [1], wherein the base is a hard base, and the plating catalytic metal is an intermediate acid.

[3] The modified resin base material according to [1] or [2], wherein the base is —$NH_2$, and the plating catalytic metal is $Cu^{2+}$.

[4] A plated substrate comprising: a modified resin base material comprising a resin material having a base at a surface thereof, and a plating catalytic metal on the surface of the resin material; and a plating layer on the modified resin base material, wherein a combination of the plating catalytic metal and the base is at least one of the following Lewis acid-base combinations according to a HSAB principle: a hard acid and a hard base or an intermediate base, an intermediate acid and a hard base, an intermediate base or a soft base, or a soft acid and an intermediate base or a soft base.

[5] The plated substrate according to [4], wherein the base is a hard base, and an acid of the plating catalytic metal is an intermediate acid.

[6] The plated substrate according to [4] or [5], wherein the base is —$NH_2$, and the plating catalytic metal is $Cu^{2+}$.

[7] The plated substrate according to any one of [4] to [6], wherein the plating layer is a copper plating layer.

[8] A method for forming a plated substrate, the method comprising: introducing a base to a surface of a resin base material; bringing a metal ion into contact with the surface to which the base has been introduced to introduce a plating catalytic metal thereto; and forming a plating layer by electroless plating on the resin base material to which the base and the plating catalytic metal have been introduced, wherein a combination of the metal ion and the base is at least one of the following Lewis acid-base combinations according to a HSAB principle: a hard acid and a hard base or an intermediate base, an intermediate acid and a hard base, an intermediate base or a soft base, or a soft acid and an intermediate base or a soft base.

[9] The method for forming a plated substrate according to [8], wherein the base is a hard base, and an acid of the plating catalytic metal is an intermediate acid.

[10] The method for forming a plated substrate according to [8] or [9], wherein the introduction of the base to the surface of the resin base material is performed by irradiating the resin base material with energy under a basic atmosphere.

[11] The method for forming a plated substrate according to [9], wherein the basic atmosphere is an ammonia atmosphere.

[12] The method for forming a plated substrate according to any one of [8] to [11], wherein the introduction of the plating catalytic metal to the surface to which the base has been introduced is performed by immersing the resin base material to which the base has been introduced in a solution containing the metal ion.

[13] The method for forming a plated substrate according to [12], wherein the metal ion is $Cu^{2+}$.

[14] The method for forming a plated substrate according to any one of [8] to [13], wherein the electroless plating is copper plating.

In the plated substrate of the present disclosure, the base and the plating catalytic metal both introduced to the base material are of a combination close in hardness as Lewis acid-base according to the HSAB principle, so that adhesion between the base material and the plating layer is enhanced.

BRIEF DESCRIPTION OF THE DRAWINGS

Further features and advantages of the present invention will become apparent from the following description of certain embodiments thereof, given by way of illustration only, not limitation, with reference to the accompanying drawings in which.

DESCRIPTION OF THE PREFERRED EMBODIMENTS OF THE INVENTION

Figure 1A:
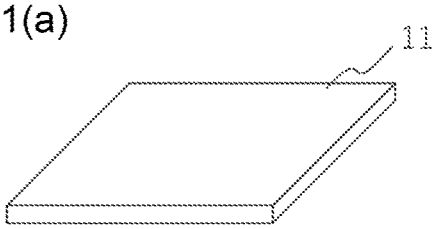
FIGS. 1(*a*) to 1(*d*) show a progression from a starting resin base material to a plated substrate of the present disclosure.
Figure 1C:
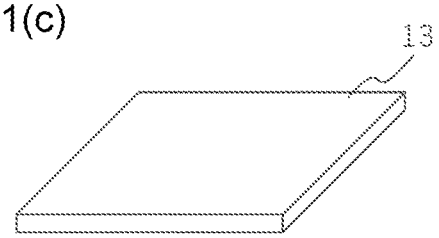
Figure 1B:
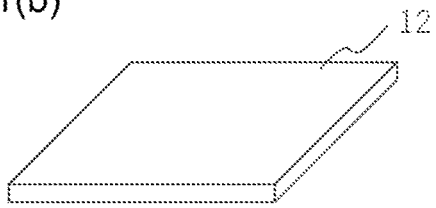
Figure 1D:
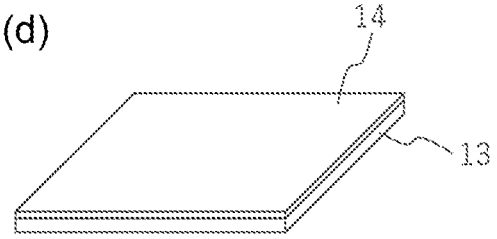

As shown in FIG. 1(*d*), the plated substrate of the present disclosure comprises: a modified resin base material 13 having a base and a plating catalytic metal both introduced to a surface of the modified resin base material, and a plating layer 14 formed on the modified resin base material 13, wherein a combination of an acid of the plating catalytic metal and the base is a combination of a hard acid and a hard base or an intermediate base, a combination of an intermediate acid and a hard base, an intermediate base or a soft base, or a combination of a soft acid and an intermediate base or a soft base according to the HSAB principle.

<Modified Resin Base Material>

The present disclosure provides a modified resin base material in which a base and a plating catalytic metal are introduced by modifying a surface of a resin base material.

The resin that forms the resin base material may be, for example, any insulating resin, and examples thereof include fluororesins such as polytetrafluoroethylene (PTFE), polyvinylidene fluoride (PVDF), polychlorotrifluoroethylene (PCTFE), perfluoroalkoxy copolymers (PFA), tetrafluoroethylene-hexafluoropropylene copolymers (FEP), ethylene-tetrafluoroethylene copolymers (ETFE), and ethylene-tetrafluoroethylene-hexafluoropropylene copolymers (FTFP); and non-fluororesins such as polyethylene, polypropylene, ethylene-propylene copolymers, ethylene-vinyl acetate copolymers (EVA), cycloolefin resin, modified polyolefin, polyvinyl chloride, polyvinylidene chloride, polystyrene, polyamide, polyimide, polyamideimide, polycarbonate, poly-(4-methylpentene-1), ionomer, acrylic resins such as polymethyl methacrylate (PMMA), acryl-styrene copolymers, butadiene-styrene copolymers, ethylene-vinyl alcohol copolymers, polyethylene terephthalate, polybutylene terephthalate, polycyclohexane terephthalate, polyether, polyetherketone, polyetherimide, polyacetal, polyphenylene oxide, modified polyphenylene oxide, polyarylate, aromatic polyester, styrene-based resins, polyurethane-based resins, chlorinated polyethylene-based resins, epoxy resin, phenol resin, urea resin, melamine resin, unsaturated polyester, silicone resin, polydimethylsilicone, polyurethane, and the like, and copolymers, blends, and polymer alloys containing them.

In a preferred embodiment, the resin forming the resin base material is preferably a fluororesin, and particularly preferably PTFE. By using a fluororesin, particularly PTFE, as the material of the resin base material 11, a base material having a low dielectric constant can be obtained.

Examples of the base include hard bases such as —$NH_2$, $NH_3$, $RNH_2$, $H_2O$, —OH, ROH, $OH^-$, $F^-$, $Cl^-$, $CH_3COO^-$, $NO_3^-$, $CO_3^-$, $ClO_4^-$, $SO_4^{2-}$, $OR^-$, and $PO_4^{3-}$, intermediate bases such as $Br^-$, $NO_2^-$, $SO_3^{2-}$, $N_3^-$, aniline, and pyridine, and soft bases such as $R_2S$, RSH, $I^-$, $RS^-$, $CN^-$, $SCN^-$, $S_2O_3^{2-}$, $S^{2-}$, $R^-$, $PR_3$, CO, and $C_2H_4$. Incidentally, R is a hydrocarbon group, and preferably an alkyl group, for example, a $C_{1-3}$ alkyl group.

Examples of the plating catalytic metal include metals composed of hard acids such as $Co^{3+}$ and $Fe^{3+}$, intermediate acids such as $Cu^{2+}$, $Fe^{2+}$, $Co^{2+}$, and $Ni^{2+}$, and soft acids such as $Cu^+$, $Ag^+$, $Au^+$, $Hg^+$, $Pd^{2+}$, and $Pt^{2+}$.

The hard base, the intermediate base, the soft base, the hard acid, the intermediate acid, and the soft acid are based on the Hard and Soft Acids and Bases (HSAB) principle.

The combination of the metal and the base is a combination close in hardness according to the HSAB principle, that is, a combination of a hard acid and a hard base or an intermediate base, a combination of an intermediate acid and a hard base, an intermediate base or a soft base, or a combination of a soft acid and an intermediate base or a soft base. Preferably, the combination of the metal and the base may be a combination of a hard acid and a hard base, a combination of an intermediate acid and an intermediate base, or a combination of a soft acid and a soft base. By adopting such a combination, the bond between the metal and the base is strengthened, and as a result, the adhesion of the plating layer formed on the plating catalytic metal composed of the metal to the base material is enhanced.

In one specific embodiment, examples of the combination of the metal and the base include a combination of $Cu^{2+}$, which is an intermediate acid, and —$NH_2$, which is a hard base.

The modified resin base material of the present disclosure has a layer of metal bonded to the surface of the base material via a base and the metal functions as a plating catalyst when plating is performed, so that plating treatment can be performed satisfactorily. When the combination of the hardness of the base and the hardness of the metal is the above combination, the adhesion between the plating layer and the base material can be enhanced.

<Plated Substrate>

The present disclosure provides a plated substrate comprising a modified resin base material having a base and a plating catalytic metal both introduced to a surface thereof, and a plating layer formed on the modified resin base material.

Examples of the metal to form the plating layer include Cu, Ag, Au, Ni, Pd, and Pt, and Cu is particularly preferable.

In a preferred embodiment, the plated substrate of the present disclosure is a substrate in which a copper plating layer is provided on a modified resin base material having —$NH_2$ introduced as a base to a surface thereof and $Cu^{2+}$ introduced as a plating catalytic metal.

In the plated substrate of the present disclosure, since the modified resin base material of the present disclosure is used as a base material and a plating layer is formed thereon, adhesion of the plating layer to the base material is high.

<Manufacturing Method>

The present disclosure provides a method for manufacturing the modified resin base material. The method for manufacturing the modified resin base material of the present disclosure is shown in FIGS. 1(*a*) to 1(*c*) and comprises introducing a base to a surface of a resin base material 11 to form the modified resin base material 12 in FIG. 1(*b*), and then introducing a plating catalytic metal to the surface of modified resin base material 12 to which the base has been introduced to form a modified resin base material 13 in which the base and the plating catalytic metal are present.

The method for introducing a base to the surface of the resin base material is not particularly limited as long as it is a method by which a base can be introduced to a surface of a base material, and examples thereof include a method in which high energy is applied to a surface of a base material in the presence of a base or a precursor thereof or in which a base material is chemically treated with a treatment agent containing a base or a precursor thereof.

In one specific embodiment, a base or a precursor thereof is enclosed in a container as a raw material to form an atmosphere of a base raw material, a base material is disposed under the atmosphere, and energy treatment is performed, whereby the base can be introduced to a surface of the base material. Examples of the energy treatment include light irradiation such as ultraviolet irradiation, excimer light irradiation, and laser irradiation, and excimer light irradiation is particularly preferable.

In a preferred embodiment, the introduction of the base can be performed by enclosing ammonia water in a container to fill the container with an ammonia atmosphere, disposing a base material therein, and irradiating the base material with excimer light.

The base or a precursor thereof is not particularly limited as long as the base can be introduced to a base material. Examples of a hard base or a precursor thereof include $NH_3$, $RNH_2$, $H_2O$, ROH, $NH_4F$, HCl, $CH_3COOH$, $HNO_3$, $(NH_4)_2CO_3$, $NH_4ClO_4$, $H_2SO_4$, $C_2H_6O$, and $(NH_4)_3PO_4$; examples of an intermediate base or a precursor thereof include $NH_4Br$, $HNO_2$, $H_2SO_3$, $NaN_3$, aniline, and pyridine; and examples of a soft base or a precursor thereof include $R_2S$, RSH, $NH_4I$, $C_2H_6S$, HCN, $NH_4SCN$, $Na_2S_2O_3$, $Na_2S$, $CH_3$, $C_2H_5$, $C_3H_7$, $PR_3$, CO, and $C_2H_4$. Incidentally, R is a hydrocarbon group, and preferably an alkyl group, for example, a $C_{1-3}$ alkyl group.

Examples of the method for introducing a plating catalytic metal to a surface of a resin base material include a method in which a base material having a base introduced to a surface as described above is brought into contact with a metal ion that is to serve as a plating catalytic metal.

In one specific embodiment, the introduction of the plating catalytic metal to the surface of the resin base material can be performed by immersing the base material having the base introduced to the surface as described above in a solution containing a metal ion as the plating catalytic metal, preferably an aqueous solution of a salt of the metal ion.

Examples of the salt of the metal ion include a nitrate, a sulfate, a hydrochloride, an oxalate, and a halide (preferably, a chloride).

In the treatment, the base and the plating catalytic metal are of a combination close in hardness as Lewis acid-base according to the HSAB principle, e.g., a combination of a hard acid and a hard base or an intermediate base, a combination of an intermediate acid and a hard base, an intermediate base or a soft base, or a combination of a soft acid and an intermediate base or a soft base.

Furthermore, the present disclosure provides a method for manufacturing the plated substrate shown in FIG. 1(*d*). The method for manufacturing the plated substrate of the present disclosure comprises obtaining a modified resin base material 13 as described above, and forming a plating layer 14 on the modified resin base material by electroless plating.

The plating layer 14 is preferably formed by electroless plating. Since the modified resin base material of the present disclosure has a plating catalytic metal on a surface thereof, a plating layer can be easily formed even by electroless plating. Furthermore, when the combination of the base and the plating catalytic metal both introduced to the resin base material is a combination close in hardness as Lewis acid-base according to the HSAB principle, a plating layer having high adhesion can be formed.

Accordingly, the present disclosure provides a method for forming a plated substrate, the method comprising: introducing a base to a surface of a resin base material; bringing a metal ion into contact with the surface to which the base has been introduced to introduce a plating catalytic metal thereto; and forming a plating layer by electroless plating on the resin base material to which the base and the plating catalytic metal have been introduced, wherein a combination of the metal ion and the base are at least one of the following Lewis acid-base combinations according to a HSAB principle: a hard acid and a hard base or an intermediate base, an intermediate acid and a hard base, an intermediate base or a soft base, or a soft acid and an intermediate base or a soft base.

EXAMPLES

Example 1

A PTFE substrate (size: about 20 mm in length, about 20 mm in width, and about 5 mm in thickness) was prepared as a resin base material. Next, 28% ammonia water was placed in a container made of polydimethylsiloxane, the PTFE substrate was disposed in the container such that it was not immersed in the ammonia water, and the container was sealed with quartz glass as a lid. The substrate was irradiated with ultraviolet rays at an output of 42 $mW/cm^2$ for 10 minutes using an excimer lamp having a wavelength of 172 nm, whereby a base was introduced to the surface.

Next, the substrate to which the base had been introduced was immersed in a 1 mol/L aqueous copper sulfate solution at 60° C. for 30 minutes, whereby a copper film that was to serve as a plating catalyst was formed on the substrate.

Next, the substrate on which the plating catalyst was formed was immersed in an electroless copper plating solution at pH 9.0 and 60° C. for 30 minutes, whereby a copper plating film having a thickness of 1.5 μm was formed.

Comparative Example

A copper plating film was formed in the same manner as in Example 1 except that the substrate to which the base had been introduced was immersed in a 0.1 mol/L aqueous palladium acetate solution instead of being immersed in the aqueous copper sulfate solution.

Evaluation of Adhesion

The copper plated films obtained in Example 1 and Comparative Example 1 were each cross-cut at 1 mm intervals, and subjected to a tape peeling test. The results of the evaluation are shown in the following table.

TABLE 1

| | Base | Plating catalytic metal | Plating catalytic metal | Residual number |
|---|---|---|---|---|
| Example 1 | $NH_3$ | $Cu^{2+}$ | Cu | 90 |
| Comparative Example 1 | $NH_3$ | Pd | Cu | 2 |

From the above results, it was confirmed that the number of residual films was larger, in other words, the adhesion was higher in the case of using a copper catalyst than in the case of using a palladium catalyst. This is considered to be because the base and the acid of the plating catalytic metal both introduced to the base material interact more strongly in the Example, in which the base and the acid were of a combination close in hardness according to the HSAB principle, namely, a combination of $Cu^{2+}$, which is an intermediate acid, and $NH_3$, which is a hard base, than in the Comparative Example, in which the base and the acid were of a combination far in hardness, namely, a combination of $Pd^{2+}$, which is a soft acid, and $NH_3$, which is a hard base.

The plated substrate of the present disclosure can be suitably used in various electronic components because of high adhesion of the plating layer.

The invention claimed is:

1. A plated substrate comprising:

a modified resin base material comprising a resin material having a base at a surface thereof, and a plating catalytic metal on the surface of the resin material, wherein the base is —$NH_2$, and the plating catalytic metal is $Cu^{2+}$ a combination of the plating catalytic metal and the base is at least; and a plating layer on the modified resin base material wherein the resin material is a fluororesin and the plating layer is a copper plating layer.

2. A method for forming a plated substrate, the method comprising:

introducing a base to a surface of a resin material;

bringing a metal ion into contact with the surface to which the base has been introduced to introduce a plating catalytic metal thereto; and forming a plating layer by electroless plating on the resin material to which the base and the plating catalytic metal have been introduced, wherein the base is —$NH_2$, and the plating catalytic metal is $Cu^{2+}$, wherein the resin base material is a fluororesin and the plating layer is a copper plating layer.

3. The method for forming a plated substrate according to claim 2, wherein the introduction of the base to the surface of the resin material is performed by irradiating the resin material with energy under an ammonia atmosphere.

4. The method for forming a plated substrate according to claim 2, wherein the introduction of the plating catalytic metal to the surface to which the base has been introduced is performed by immersing the resin material to which the base has been introduced in a solution containing the metal ion.

* * * * *